US010760251B2

(12) United States Patent
Goodman

(10) Patent No.: US 10,760,251 B2
(45) Date of Patent: Sep. 1, 2020

(54) POWER PLUNGER

(71) Applicant: Daniel G. Goodman, Lake Havasu City, AZ (US)

(72) Inventor: Daniel G. Goodman, Lake Havasu City, AZ (US)

( * ) Notice: Subject to any disclaimer, the term of this patent is extended or adjusted under 35 U.S.C. 154(b) by 0 days.

(21) Appl. No.: 15/623,724

(22) Filed: Jun. 15, 2017

(65) Prior Publication Data

US 2020/0123750 A1 Apr. 23, 2020

Related U.S. Application Data

(63) Continuation-in-part of application No. 15/153,364, filed on May 12, 2016, now abandoned.

(51) Int. Cl.
*E03C 1/30* (2006.01)

(52) U.S. Cl.
CPC ..... *E03C 1/30* (2013.01)

(58) Field of Classification Search
CPC ..... E04H 4/1209
USPC ..... 4/255.02
See application file for complete search history.

(56) References Cited

U.S. PATENT DOCUMENTS

| | | | | | |
|---|---|---|---|---|---|
| 2,649,154 | A * | 8/1953 | Adrian | B26D 5/12 | 83/643 |
| 4,257,540 | A * | 3/1981 | Wegmann | F16N 3/12 | 184/105.2 |
| 4,955,935 | A * | 9/1990 | Katayama | B60K 20/06 | 192/220.2 |
| 5,830,254 | A * | 11/1998 | Roberts | C03B 9/165 | 65/359 |
| 5,958,101 | A * | 9/1999 | Pinkerton | C03B 9/16 | 425/451 |
| 9,545,643 | B2 * | 1/2017 | Thompson | B25F 3/00 | |
| 2013/0131683 | A1 * | 5/2013 | Shah | A61B 17/8802 | 606/93 |
| 2013/0152293 | A1 * | 6/2013 | Yu | A47K 13/10 | 4/406 |
| 2013/0277455 | A1 * | 10/2013 | Thompson | B25F 3/00 | 239/289 |

* cited by examiner

*Primary Examiner* — Lori L Baker
(74) *Attorney, Agent, or Firm* — Bruce A. Lev

(57) ABSTRACT

A power plunger including a barrel member as a housing for a piston, a connecting rod, a crank having a pushing mechanism, a power supply, and an actuating switch. The power plunger provides splash-back free unclogging of drains.

9 Claims, 6 Drawing Sheets

POWER PLUNGER

CROSS-REFERENCE TO RELATED APPLICATION

The present application is related to and claims priority from prior application Ser. No. 15/153,364, filed May 12, 2016 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates to the field of the power plunger. The invention, particularly relates to a power plunger which is being to be used for unclogging the drains, toilet pipe and the like without any splashback of dirty water.

2. Background of the Invention

There are few annoying tasks for home repairs that demand immediate attention of a person like clogged drains. Regardless of what a person is doing, generally have to stop everything to fix it, else the inadvertently flood on the floor, or lose the use of the sink, tub, or toilet. So, unclogging a drain is not always a simple task, if the person is having any tool to unclog the drain or toilet pipe.

Conventionally, simply flush the drain with a tea kettle of boiling water, but it's not guaranteed to unclog physical or grease blockages, but if the person has a slow drain i.e. due to a light or small blockage, a good boiling water flush can clear it out with minimal effort. Wait until the sink or tub has finally drained, and then flush with water. Although, some drain cleaners are only effective on certain kinds of clogs. The person could run out and buy a bottle of commercial drain cleaner, but even many plumbers will suggest that it should be a last resort. In addition, there are few available devices consists of a solid handle and a hemispherical suction cup, the device being operated by placing the suction cup directly on the opening of a pipe or the like and pressing down repeatedly on the handle.

There have been a number of solutions provided for easy unclogging of the drains, toilet pipes, etc., and few of them have been discussed below:

U.S. Pat. No. 6,035,455 discloses a portable power plunger for unclogging blocked drains in sinks, toilets, bathtubs and the like. The plunger has a main body having a reciprocating pump with a removable attachment mounted at its outlet lower end, which is adapted to cover intimately over the waste water drain of a sink, toilet, or bathtub. The drain may be unclogged by operating the pump to dislodge the blockage and to dispose of it down the sewer. The pump is provided with a substantial back flow prevent or such that the dirty water in the drain would not back into the pump to contaminate the latter. An integral injector pipe is also provided on the plunger. The injector pipe extends into an interior compartment at the lower part of the housing between the back flow prevent or and the outlet, and it is attached to a pneumatic pressure source or pressurized water supply. The pneumatic pressure or pressurized water provides additional pressure to unclog the blockage in the drain or for drawing dirty water out from the drain.

U.S. Pat. No. 8,544,122 relates to a toilet plunger for unclogging drains, such as those typically associated with a toilet, preferably comprised of a stem, a bell with a generally oblong opening, and a plurality of baffles attached to the bell. The unique shape of the bell and bell opening, combined with the presence and function of the baffles, make the improved plunger device particularly effective for unclogging modern trough-like toilet drains.

US 20120066823 describes a toilet plunger which is used to unclog a drain of a toilet by removing impurities. The toilet plunger includes a gas container, with an opening thereof closed by a closing plate. A body has defined therein a passage extending in the lengthwise direction to allow gas to pass through and a gas container-receiving portion. A puncture pin is disposed in the central portion of the gas container-receiving portion. A cover has an inner space for receiving a portion of the gas container opposite the opening. The cover is a screw-coupled to the upper portion of the body, such that the container is moved toward the puncture pin according to a screw motion. An insert is connected to the lower end of the body to guide the discharged gas along the passage toward the drain. A portion of the insert, which is intermediate in length, is bent in one direction.

The aforesaid documents and other similar solutions may strive to provide the improved toilet plunger. Restated, consumers need a powered, lightweight structure that organizes in addition to appealing to the senses. For example, consumers long felt need to a power plunger having a splash free mechanism during unclogging operation. Moreover, there is a need for an improved system that promotes the use of the power plunger with easy holding. In other words, there is a need for an electrical plunging system to use it easily without having to have help from someone so that the system actually contributes to the realism of the unclogging the drain and toilet pipes to encourage use.

Accordingly, the present invention overcomes the disadvantages associated with the prior art, by providing a jewelry item having a designated space for incorporating hologram in the jewelry article and other advantageous feature of making the same communicably active with multimedia devices.

BRIEF SUMMARY OF THE INVENTION

In view of the foregoing disadvantages inherent in the known types of ornamental jewelry or like in the prior art, the present invention provides an improved article of jewelry preferably a necklace with a hologram to present various types of holograms in the front and make it more decoratively appealable. As such, the general purpose of the present invention, which will be described subsequently in greater detail, is to provide a new and improved hologram containing necklace with all the advantages of the prior art and none of the disadvantages.

It is an object of the present invention to provide a power plunger that includes a barrel to provide a housing for a piston, a connecting rod and a crank with a pushing mechanism, a means for power to provide power supply to the housing for the pushing mechanism and an actuating switch to activate the means for power.

A further object of the present invention is to provide the power plunger which can also be used by the elderly person easily without having to have help from someone.

A further object of the present invention is to provide the power plunger which has an electric motor for providing better cleaning to the drains of toilets.

An additional object of the present invention to provide the power plunger that provides a splashback free process while unclogging the drain or the toilet pipe and the like, hence making a pleasant atmosphere.

An additional object of the present invention to provide the power plunger which is easy to produce and economical to use, because of simple attachments and available for the various draining system.

An additional object of the present invention to provide the power plunger i.e. made of material selected from the group comprises of, but not limited to, PVC pipe, aluminum, leather, rubber, sanitary hardware and the like.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting

BRIEF DESCRIPTION OF THE DRAWINGS

The figures which accompany the written portion of this specification illustrate embodiments according to the teachings of the present invention.

Figure 1A:
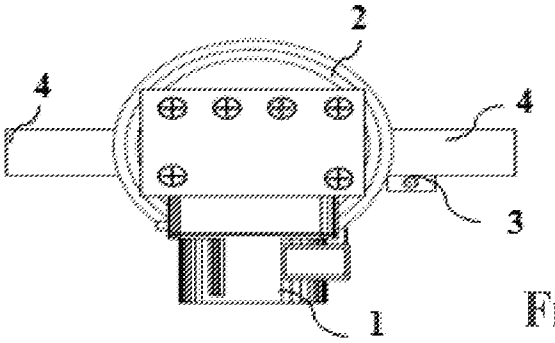
FIG. 1A is a top side view of a power plunger in accordance with an embodiment of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

The present invention generally provides a power plunger comprises a barrel (1) to provide a housing, a pair of handles (4), an internal piston (5) resides within the housing, a connecting rod (6), a crank (7) with a pushing mechanism (8), an output shaft (12), a means for power (2) formed as an electric motor, a plurality of brackets, a rubber seal (9) and a leather seal (10) adjacent opening (11), a coupling device, a plurality of shafts and an actuating switch (3) to activate the means for power. Further, the barrel has divided into two sections i.e. a top end section and a bottom end section.

Figure 1B:
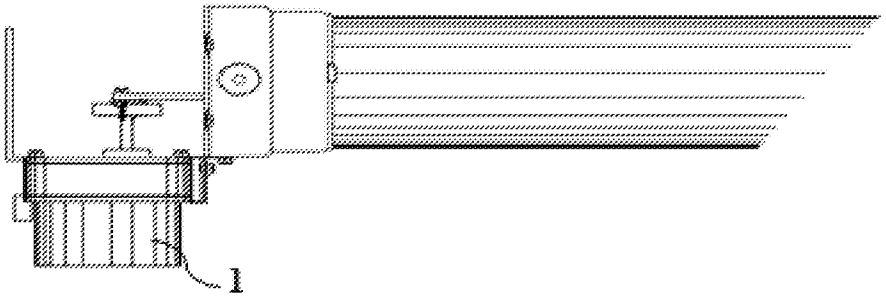
FIG. 1B is a right side view of the power plunger as shown in FIG. 1A.

As shown in FIGS. 1A and 1B, a power plunger having a means for power (2) which is mounted on a barrel for providing an electrically operated internal piston with a movable in an upwardly and downwardly direction while pressing the actuating switch (3) by the user. FIGS. 1A and 1B further show how the other means are effectively engaged with the inbuilt structure of the plunger to unclogging the opening of the drain.

In accordance with an embodiment of the present invention, the power plunger is also having other means for providing a rubber seal at the bottom end section of the barrel (1) to receive the opening of a draining point. The power plunger is easily operated using the pair of handles and applied a pushing mechanism to the internal piston. The means for power includes an electric motor, a gear reduction device and a cable cord and uses a standard alternate current, but not limited to, of 110 Volt which is activated by an actuating switch.

The means for power is used, but not limited to, an electric motor of 25 watt output having 120v alternate current. The power for means uses a gear reduction device to control the speed of operation, but not limited to, 200 r.p.m. or 200 strokes per minute. On the output shaft of the electric motor is having a, but not limited to, ⅜ inch thick and 1.5 inch diameter round stock piece of steel called the crank. The crank is held on to the motorshaft with a set screw drilled into the edge of the unit. On the round face of the crank have drilled 3 holes, therein, a center hole is drilled to 10 mm to slide onto the shaft. From the center outward there is another, ¼ inch set of holes drilled through ½ inch from the center in a straight line. Attached to it, the size of the piece is, but not limited to, (¾×¼×¼×2⅕) inch piece of flat stock. Preferably, the holes in this piece are, but not limited to, ¼ inch from the one end and 1¼ inch from the other end, and the other hole is drilled and taped at, but not limited to, 2 inches. All holes are on center and the set of ¼ inches holes are chamfered for a flat head having ¼ inch allen screw. The taped hole is mounted on the connecting rod which goes into the piston. This motor mounted unit is configured to provide the crankshaft module.

Figures 2A, 2B:
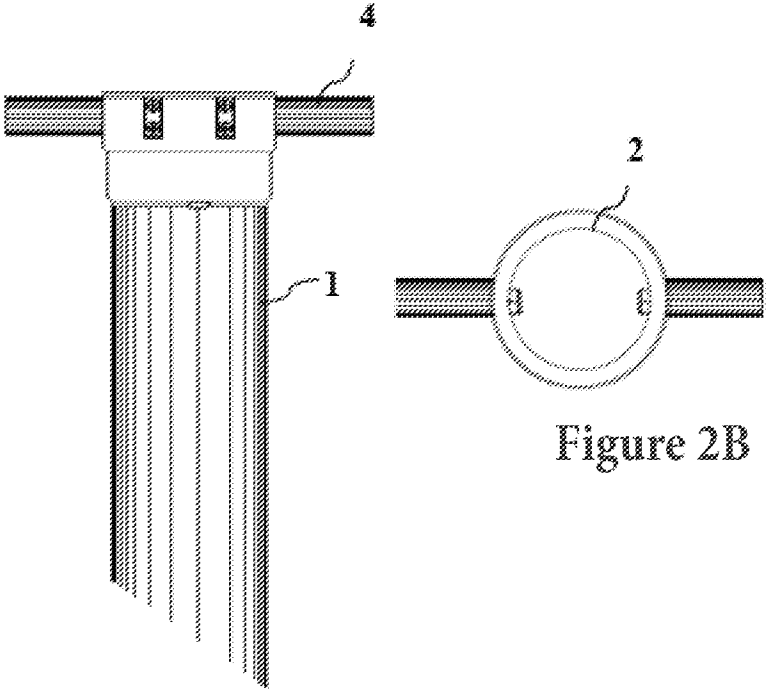
FIG. 2A illustrates a front view of the power plunger as shown in FIG. 1A.
FIG. 2B is a rear view of the power plunger as shown in FIG. 1A.

FIGS. 2A and 2B are front and rear views of the power plunger of FIGS. 1A and 1B. The present invention provides a very flexible power plunging system using the plurality of brackets and coupling device to provide the means for attaching the various part for the invention.

In accordance with an embodiment of the present invention, the electric motor (2) of the power plunger are made of, but not limited to, the three pieces of angle iron on each side of the electric motor. Preferably, the angle iron is cut to a length of ½ inch. These pieces are cut and drilled as per the surface of the electric motor and attached with the top end section of the plunger body. The actuating switch is installed on the one side of the handle using a piece of, but not limited to, (⅛×1½×¾) inches angle wide. The main body of the power plunger is, but not limited to, 20 inch long piece of the barrel (1) or PVC pipe having a 3 inch diameter from inside. At the one end of the electric motor, preferably, a 4-3 inch reducer is glued in an insert place and an insert of the housing of the barrel, which is 4 inch side is glued into that insert place and sanded flush with the reducer.

Figure 3:
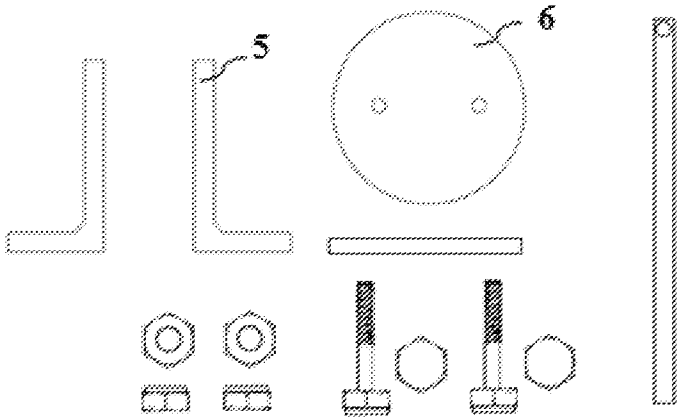
FIG. 3 illustrates various attachments of the power plunger as shown in FIG. 1A.
Figure 4:
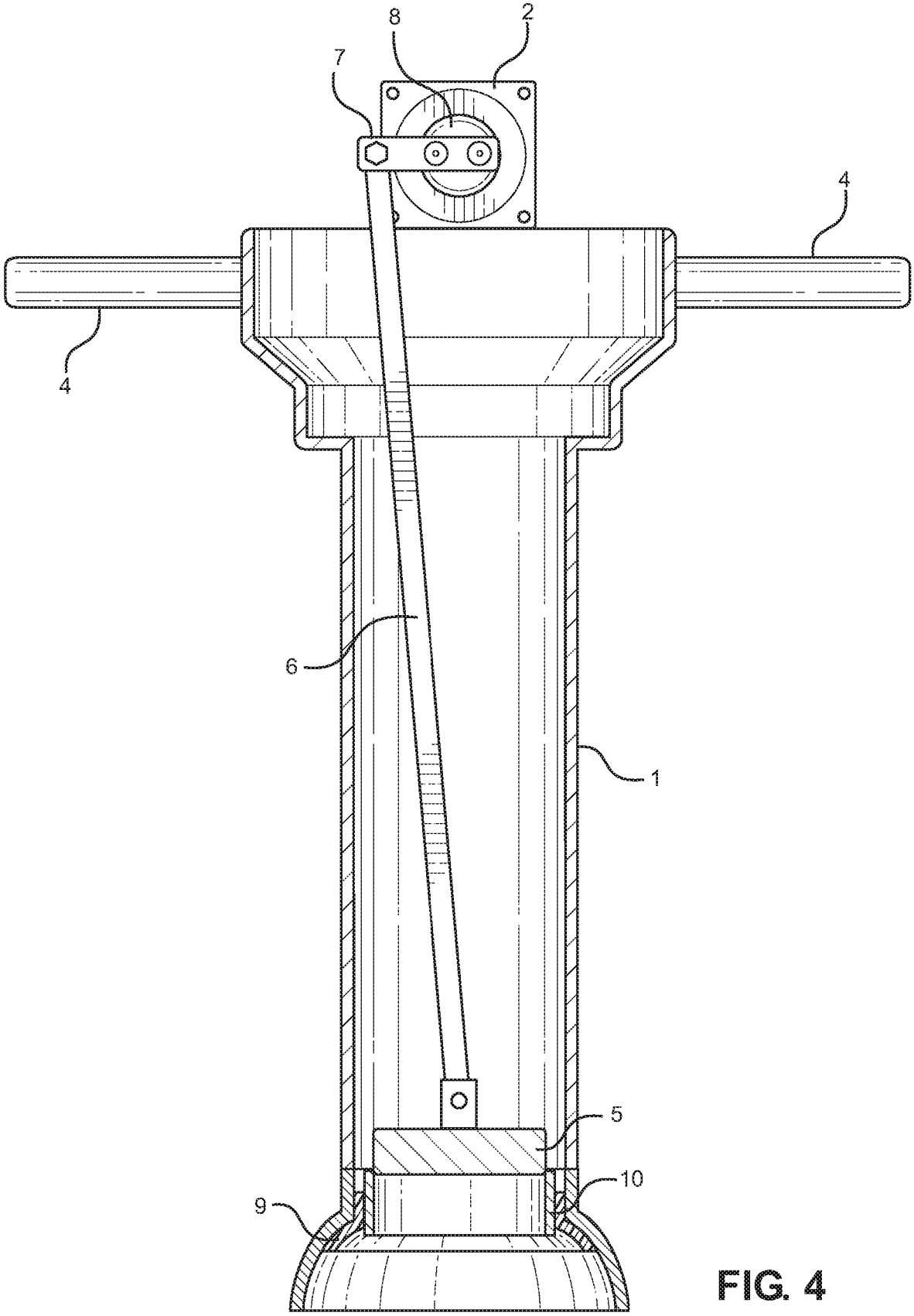
FIG. 4 illustrates a cross-sectional view of the preferred embodiment of the power plunger.
Figure 5:
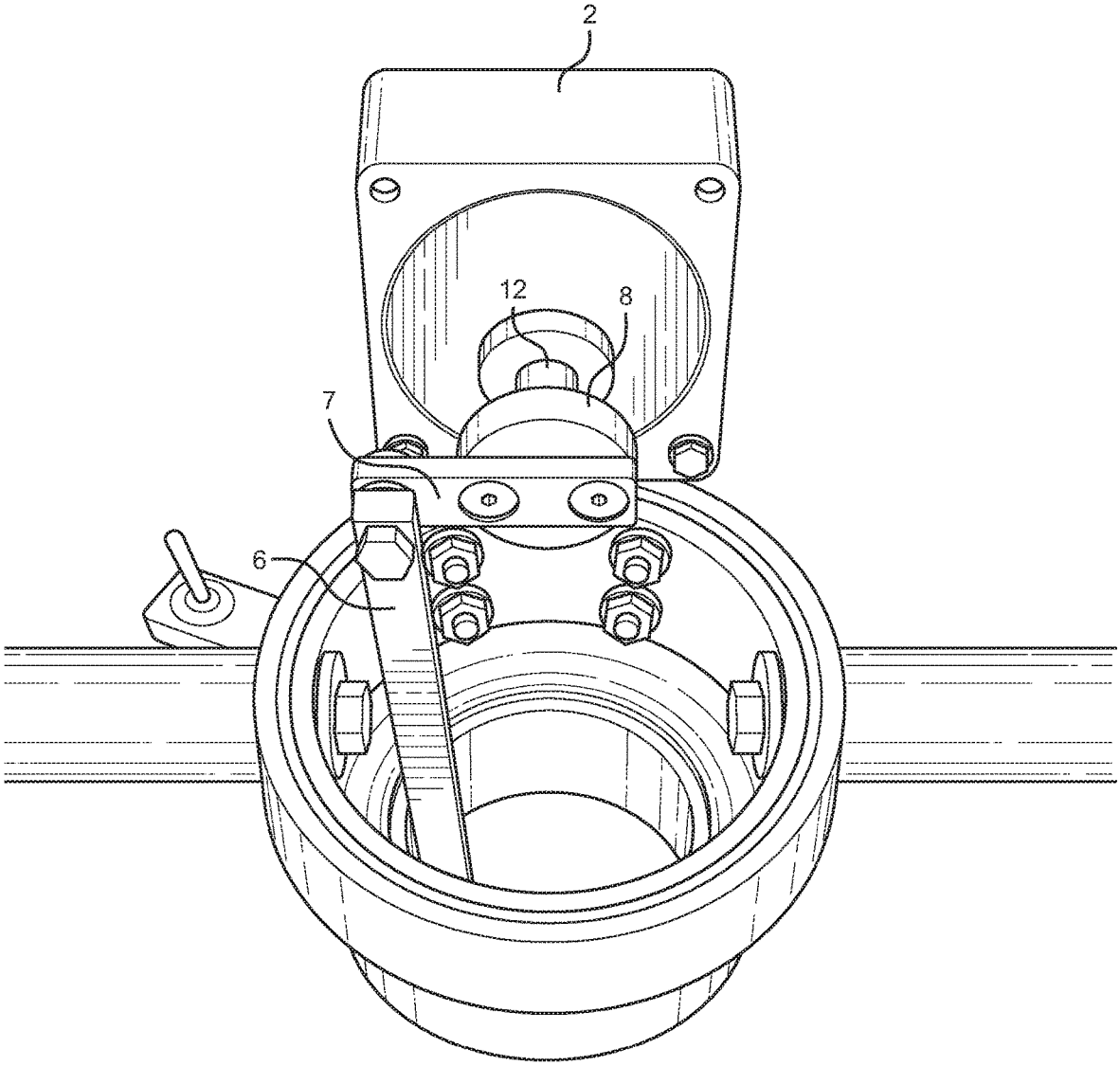
FIG. 5 illustrates a top perspective view of the preferred embodiment of the power plunger.
Figure 6:
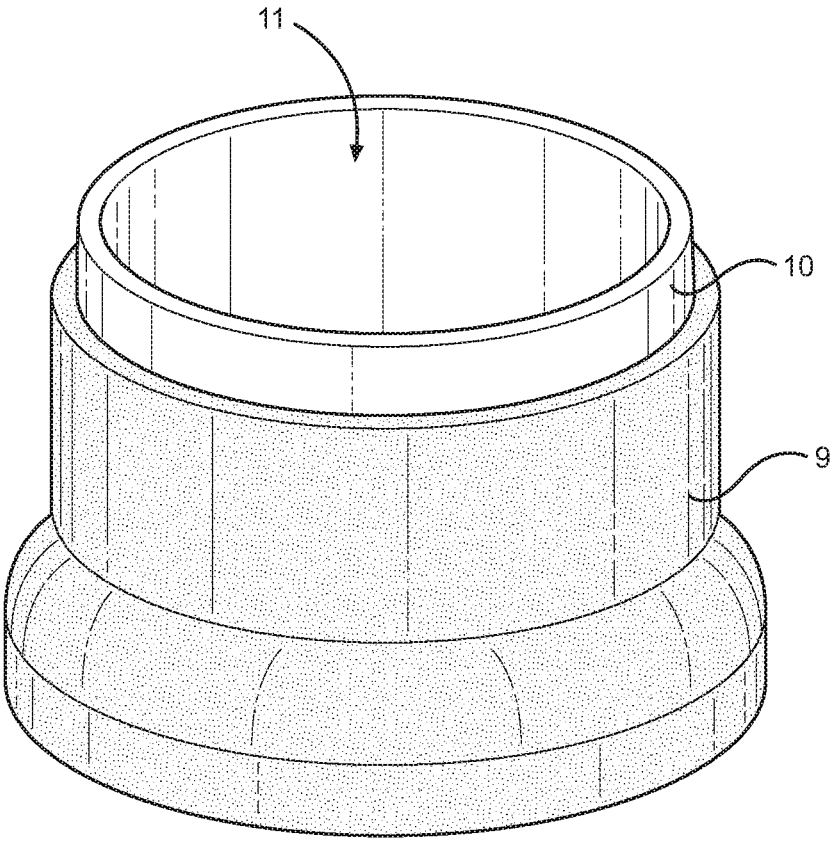
FIG. 6 illustrates a top perspective view of the rubber seal and leather seal of the preferred embodiment of the power plunger.

Referring to FIG. 3, shows various attachments of the power plunger such as plurality of brackets (5), coupling device, a plurality of nuts, bolts and an internal piston. Preferably, the piston is made of, but not limited to, wood having a 3 inch diameter round and 1.5 inches long.

In accordance with an embodiment of the present invention, the set of holes (6) is required to be drilled on the centerline to mount the connecting rod with the other sealing assembly. The connecting rod is mounted to the crankshaft assembly of the electric motor on one end and the piston on the other end. The piston slides inside the PVC pipe or a barrel with an upward and downward motion to unclog a drain. The leather seal on the piston is configured to be coated with grease to assure an air tight and water tight seal.

The above-mentioned power plunging system is a very effective for unclogging the drain, toilet pipes and the like by placing the rubber seal of the barrel or PVC pipe over the opening of the clogged drain and with slight pressure which turns the unit on using the actuating switch. Also, holding the power plunger by the handles while users are operating the system. Preferably, the system plunges the drain at a speed of, but not limited to, 200 strokes per minute. The power plunger makes plunging a clogged drain simple with easy handling and works in most cases better than the other plunger which requires effort. In addition, the power plunger protects the user from splashback and provides a pleasant method of unclogging the drain. Further, the attachment of the plunging system is not limited to a specific size and dimension, although the system can be manufactured as per the need of the manufacturer. The whole structure is very simple for production and very economical in use.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A power plunger, comprising:

a barrel adapted to provide a housing for a piston, a connecting rod and a crank with a pushing mechanism;

a means for power adapted to provide power to said housing for said pushing mechanism;

an actuating switch adapted to activate said means for power; and wherein said barrel is selected from the group comprising PVC pipe, water draining pipe, and any combination thereof.

2. The power plunger according to claim 1, wherein said means for power is mounted on said barrel of said power plunger.

3. The power plunger according to claim 1, wherein said barrel is having a top end section and bottom end section.

4. The power plunger according to claim 1, wherein said barrel is provided with a rubber seal at said bottom end section adjacent an opening thereof.

5. The power plunger according to claim 1, wherein a pair of handles are placed at said top end section of said barrel.

6. The power plunger according to claim 1, wherein said power plunger includes a handle; and wherein said actuating switch is installed on said handle of said power plunger.

7. A power plunger, comprising:

a barrel adapted to provide a housing for a piston, a connecting rod and a crank with a pushing mechanism;

a means for power adapted to provide power to said housing for said pushing mechanism;

an actuating switch adapted to activate said means for power;

wherein said means for power includes an electric motor, a gear reduction device, and a cable cord;

wherein said electric motor is adapted for installing an output shaft for placing a crank; and wherein said crank includes a plurality of holes for connecting said connecting rod.

8. The power plunger according to claim 7, wherein said gear reduction device is controlling the speed of said electric motor.

9. A power plunger, comprising:

a barrel adapted to provide a housing for a piston, a connecting rod and a crank with a pushing mechanism;

a means for power adapted to provide power to said housing for said pushing mechanism;

an actuating switch adapted to activate said means for power;

wherein said piston is configured to have a leather seal at a bottom end section of said barrel using a rubber seal; and wherein said piston and said crank are connected by said connecting rod to drive said piston in upward and downward direction.

* * * * *